US007963471B2

(12) United States Patent
Chen

(10) Patent No.: US 7,963,471 B2
(45) Date of Patent: Jun. 21, 2011

(54) FINE GRINDING ROLLER MILL

(75) Inventor: Michael M. Chen, Naperville, IL (US)

(73) Assignee: ALSTOM Technology Ltd, Baden (CH)

( * ) Notice: Subject to any disclaimer, the term of this patent is extended or adjusted under 35 U.S.C. 154(b) by 137 days.

(21) Appl. No.: 12/270,073

(22) Filed: Nov. 13, 2008

(65) Prior Publication Data

US 2009/0121060 A1 May 14, 2009

Related U.S. Application Data

(63) Continuation-in-part of application No. 11/939,621, filed on Nov. 14, 2007, now Pat. No. 7,665,681.

(51) Int. Cl.
*B02C 15/08* (2006.01)

(52) U.S. Cl. ..... 241/129

(58) Field of Classification Search ..... 241/52, 241/57, 79.1, 80, 119, 129
See application file for complete search history.

(56) References Cited

U.S. PATENT DOCUMENTS

| | | | | |
|---|---|---|---|---|
| 1,358,837 | A * | 11/1920 | Fuller | 241/74 |
| 1,519,990 | A * | 12/1924 | Breerwood | 241/173 |
| 1,752,623 | A * | 4/1930 | Uhle et al. | 241/173 |
| 1,834,094 | A | 12/1931 | George | |
| 4,640,464 | A | 2/1987 | Musto et al. | |
| 5,279,466 | A | 1/1994 | Williams | |
| 5,330,110 | A | 7/1994 | Williams | |
| 6,902,126 | B2 | 6/2005 | Chen et al. | |
| 7,028,837 | B2 | 4/2006 | Chen et al. | |

FOREIGN PATENT DOCUMENTS

| | | |
|---|---|---|
| GB | 25137 | 7/1912 |
| JP | 58-92467 | 6/1983 |

OTHER PUBLICATIONS

PCT International Search Report and The Written Opinion of the International Searching Authority dated Oct. 6, 2009—(PCT/US2008/083565).

* cited by examiner

*Primary Examiner* — Mark Rosenbaum
(74) *Attorney, Agent, or Firm* — Lawrence P. Zale

(57) ABSTRACT

A roller mill 10 for pulverizing fine material has a grinding mechanism that includes a plurality of grinding rolls 64 and a grinding ring 66 that coact to pulverize material within a mill housing. The grinding ring has an inner grinding surface wherein the inner surface includes an upper vertical portion and inwardly sloped lower portion. The lower portion of the ring provides a means for retaining more fine particles on the ring during pulverizing, as well as an increase in grinding surface. The grinding rolls have a generally cylindrical shape with an outer grinding surface that includes an upper vertical portion and a lower portion of the outer grinding surface. The outer grinding surface of the roll is complementary to the inner grinding surface of the grinding ring.

15 Claims, 5 Drawing Sheets

FINE GRINDING ROLLER MILL

CROSS-REFERENCE TO RELATED APPLICATION

This application is a continuation in part of U.S. patent application Ser. No. 11/939,621 filed Nov. 14, 2007, which is incorporated herein by reference in its entirety.

TECHNICAL FIELD

The present disclosure relates generally to a roller mill, and more particularly, to a vertical roller mill having a grinding mechanism to improve the grinding efficiency.

BACKGROUND

It has long been known in the prior art to provide apparatus for purposes of effecting the grinding and pulverizing of certain materials. More specifically, the prior art is replete with examples of various types of apparatus that have been used to effect such grinding of a multiplicity of materials. Coal is one such material wherein there is a need that it be ground to a particular fineness in order to render it suitable for the use in, for example, a coal-fired steam generating power plan.

One particular coal pulverizing apparatus, which is to be found in the prior art, is a roller mill. An exemplary roller mill with an integral classifier is shown and described in U.S. Pat. Nos. 4,640,464 and 7,028,847. An exemplary roller mill 10 having an integral classifier 12 is depicted in FIG. 1. As is typical of such a vertical roller mill, the mill includes a plurality of grinding rolls 14 that toll along a grinding ring 16 for pulverizing the material to a desired particle size, which defines a grinding zone 18. A blower (not shown) generates an upward airflow 20 that draws fine particles upward through a grinding chamber 22 to the classifier 12 disposed above the mill housing 24 and in fluid communication therewith. The classifier has a centrifugal-type separator 25 that separates the oversize particles from the finer particles. An airflow 28 having finer particles pass through the classifier 12 through an output duct or port 26 while the airflow 30 having oversized particles fall back down to the grinding chamber 22 and rolls 14 for continued grinding. The airflow 30 also includes fine particles. Some of these fine particles may continue to circulate within the grinding chamber 22 without being further ground as shown at 34.

It has been found that when the roller mill in the prior art is used for grinding fine particle sizes, the roll tends to pound the ring and generate high vibration and noise levels. It is believed that this high vibration may be due to one or more factors. One factor is the lack of sufficient material in between the rolls and ring. The ground material (e.g., particles) is so fine that the particles are very easily blown away by the upward airflow. Another factor is the skidding or sliding of the roll along the grinding ring because the fine particles disposed between the roll and ring are so fine that the fine particles act like a lubricant between the roll and ring.

What is needed, therefore, is a means for overcoming or at least reducing the severity of the increased vibration, noise level, and/or roll skidding as described hereinbefore. The improved fine grinding roller mill roll and grinding ring design disclosed herewith reduces these problems by keeping more material in the grinding area and results in an increase mill throughput or decrease of the mill power consumption.

SUMMARY

According to the other aspects illustrated herein, there is a mill for pulverizing material having a According to the aspects illustrated herein, there is provided a grinding mechanism for a roller mill for pulverizing material includes a grinding ring and a roll that coacts with the grinding ring to pulverize the material. The grinding ring has an inner grinding surface wherein the inner surface includes an inwardly sloped lower portion. The grinding roll has a generally cylindrical shape with an outer grinding surface. A lower portion of the outer grinding surface is complementary to the inner grinding surface of the grinding ring.

According to the other aspects illustrated herein, there is a grinding mechanism for a roller mill for pulverizing material includes a grinding ring and a roll that coacts with the grinding ring to pulverize the material. The grinding ring has an inner grinding surface. The grinding roll has a generally cylindrical shape with an outer grinding surface. At least one of the inner surface of the ring and the outer surface of the roll includes a tread.

The above described and other features are exemplified by the following figures and detailed description.

BRIEF DESCRIPTION OF THE DRAWINGS

Referring now to the Figures, which are exemplary embodiments, and wherein the like elements are numbered alike.

DETAILED DESCRIPTION

Figure 2:
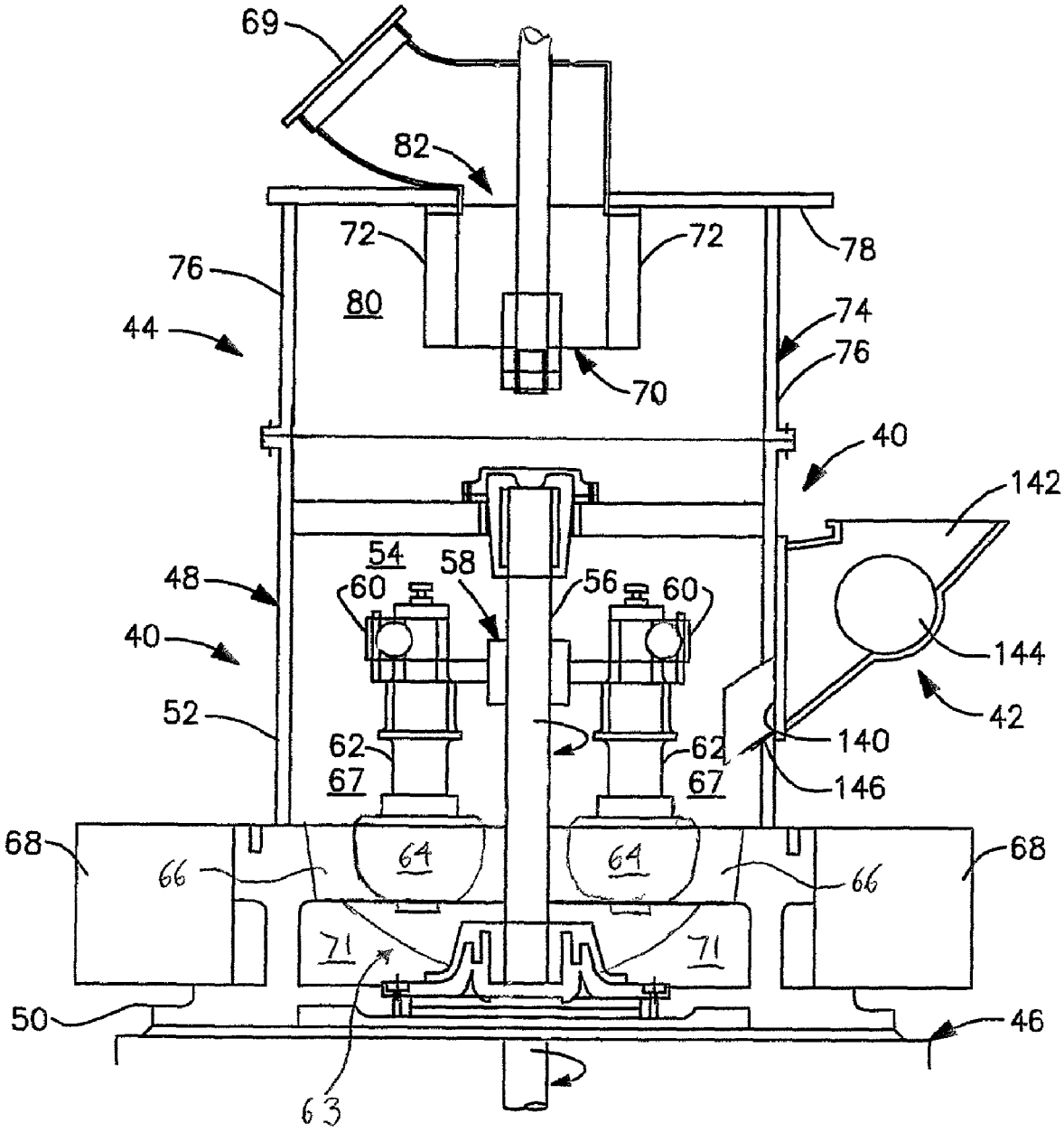
FIG. 2 is a cross-sectional view of a roller mill including a grinding mechanism in accordance with the present invention.

Referring to FIG. 2, a vertical roller mill, generally designated by reference numeral 40, is depicted therein with a rotary feeder 42 and classifier 44, illustrated cooperatively associated therewith. Inasmuch as the nature of the construction and the mode of operation of roller mills per se are well-known to those skilled in the art, it is not deemed necessary, therefore, to set forth herein a detailed description of the roller mill 40 illustrated in FIG. 2. Provided herein is merely a description of the nature of the construction and the mode of operation of the components of the roller mill 40, the rotary feeder 42, and the classifier 44. For a more detailed description of the nature of the construction of the components of the roller mill 40 and classifier 44 one may refer to U.S. Pat. No. 4,640,464 and U.S. Pat. No. 6,902,126, which is incorporated herein by reference.

Referring to FIG. 2, the roller mill 40 in accordance with the present invention as illustrated therein includes a mill base 46 to which a mill side 48 is suitably affixed in known fashion. The mill side 48 includes a mill side base 50 and an annular wall 52 attached in known fashion to the mill side base to form a grinding chamber 54 wherein the grinding takes place. Housed within the mill base 46 and extending upwardly into the mill side 48 is a mill shaft 56, which is part of a gear assembly (not shown). The gear assembly functions in a conventional fashion, such that a mill motor (not shown) drives the gear assembly in a known fashion to thereby rotate the mill shaft 56 in either a clockwise or counterclockwise direction.

A spider 58 is suitably mounted at the upper end of a mill shaft 56 of the gear assembly so as to be rotatable therewith. Moreover, the spider 58 has a plurality of trunnion bearing assemblies 60 cooperatively associated therewith in a suitable fashion. In accordance with the illustration of the roller mill 40 of FIG. 2, two such trunnion bearing assemblies 60 are shown cooperatively associated with the spider 58. In FIG. 2, a journal assembly 62 is associated with each of the trunnion bearing assemblies 60. Furthermore, on each of the journal assemblies 62 there is suitably mounted a grinding roll 64. The grinding rolls 64 to which further reference will be had hereinafter comprise one of the grinding elements of the roller mill 40. While two grinding rolls 64 are shown in FIG. 2, one will appreciate that the roller mill may have 3, 4 or more grinding rolls.

The grinding rolls 64 coact with a grinding ring 66 to pulverize the material passing therebetween, which is defined as the grinding zone 67 in the grinding chamber 54. The grinding ring 66, which is essentially circular in configuration, is suitably mounted through the use of conventional mounting means (not shown) within the mill side base 50 of the roller mill 40 so as to be positioned in juxtaposed relation to the grinding rolls 64. The journal assemblies 60 are actuated to urge trunnions 60 and thus the rolls against the grinding ring. A plow assembly 63 is mounted to an intermediate portion of the mill shaft 56 below the grinding ring 66. The plow assembly 63 includes a plurality of blades 71 that extend radially outward from the shaft. As the blades 71 rotate with the mill shaft 56, the blades push the material fallen through the grinding ring and roll upward onto the grinding ring for grinding.

The roller mill 40 also includes an annular return air housing 68. The return air housing 68 is suitably located in juxtaposition relation to the mill side base 50 of the roller mill 40 so as to provide a flow path for airflow between the interior and the exterior of the roller mill.

The classifier 44 is mounted in conventional fashion on the mill side 48 of the roller mill 40 so as to be coaxially aligned therewith. Further, in known fashion the classifier 44 is operative to separate particles according to particle size of the material that has been ground within the roller mill 40 through the coaction of the grinding rolls 64 with the grinding ring 66. The classifier 44 is suitably provided at the upper end thereof with an outlet or duct 69.

The classifier 44 depicted in FIG. 2 is an example of a centrifugal-type classifier, which has a rotor 70 carrying a plurality of circumferentially-spaced blades 72 that extend outwardly. The rotor is disposed within an open-ended housing 74 having side walls 76 and a top wall 78, which defines a separator chamber 80. The duct 69 is in fluid communication with the separator chamber 80 through an opening 82 in the top wall 78. A motor (not shown) rotates the rotor 70 of the classifier 44 in either the clockwise or counterclockwise direction.

Figure 4:
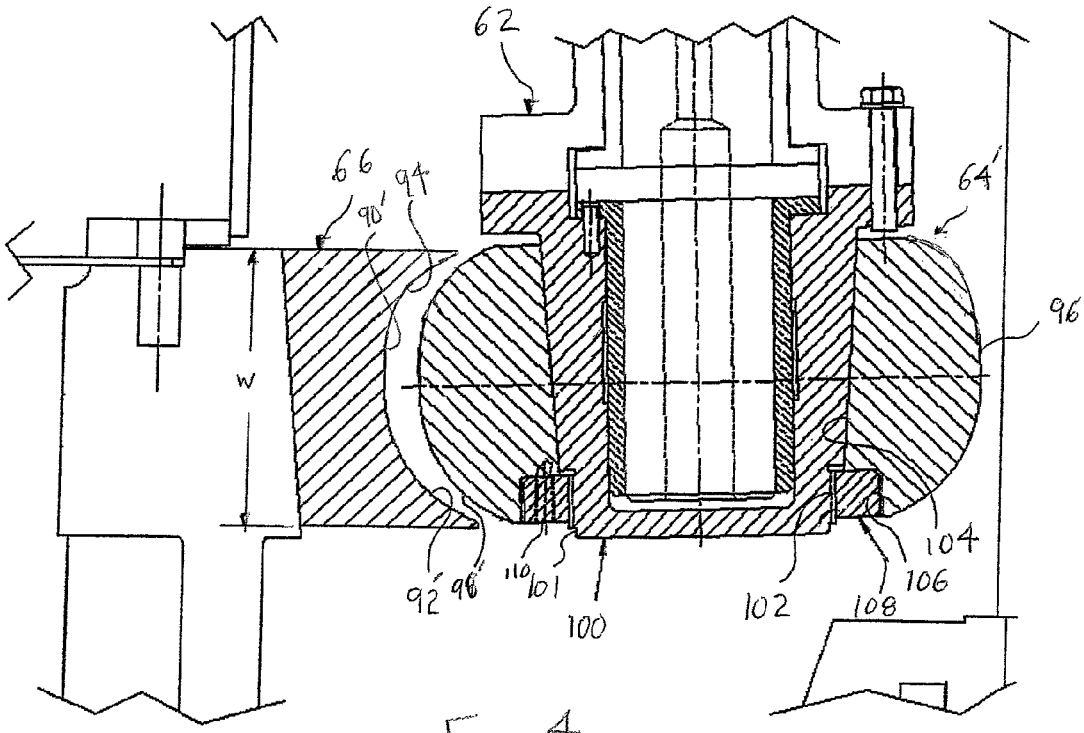
FIG. 4 is a cross-sectional view of a lower portion of the roller mill of FIG. 2 illustrating a lower portion of the grinding mechanism illustrating an alternative roll and grinding ring arrangement in accordance with the present invention.

In the operation of the classifier 44, as best shown in FIGS. 2 and 4, a blower (not shown) draws air upwardly from the return air housing 68 through the grinding zone 67, the grinding chamber 54, and the separator chamber 80, and then out through the duct 69. As airflow 94 passes up through the grinding rolls 64 and grinding ring 66, fine ground particles are picked up in the airflow. The fine particles are carried in airflow 96 through the grinding chamber 54 into the separator chamber 80, where the particle-laden air is drawn through the rotating blades 72 of the rotor 70 of the classifier 44. As the particle-laden air passes through the rotating blades, the finer particles flow past the blades and out of the duct 69 as depicted by airflow 98, while the larger oversized particles are being propelled towards the classifier housing by centrifugal force, which then fall downwards back to the grinding chamber 54 by gravity, as depicted by particle flow 99. Classifiers that function in this manner of using a rotor 70 having a plurality of blades 72 for separating the fine particles from the oversized particles are known in the prior art as centrifugal type classifiers. Other centrifugal type classifiers are a turbine, a single stage whizzer and a double stage whizzer.

Referring to FIG. 2, the mill side wall 52 of the roller miller 40 includes a feed opening 140 for feeding material into the grinding chamber 54. A rotary feeder 42 is attached to the side of the mill side wall 52 for feeding the material through the opening 140 in the mill side wall. The rotary feeder includes a hopper 142 for receiving material to be pulverized in the roller mill and a rotary means 144 for moving the material through the opening 140 and into the grinding chamber 54.

In accordance with the mode of operation of the roller mill 40 of FIG. 2, the material, to be pulverized or ground therein is introduced at a controlled rate by means of the rotary feeder 42. Upon entering the roller mill, the material to be ground falls to the bottom of the mill. Thereafter, the rotating blades 71 of the plow assembly 63, which are set at an angle in front of the rolls, cause the material to be scooped up in a continuous stream such that the material passes between the rolls and the grinding ring in the grinding zone 67 whereupon the material is pulverized through the coaction of the rolls and the ring. As a result of the coaction between the grinding rolls 64 and the grinding ring 66, the pulverization, i.e., grinding, of the material occurs.

A large volume of air enters the roller mill 40 through tangential ports with which the air vents 68 provide for this purpose immediately below the grinding ring 66. This large volume of air is operative to sweep the fine and medium fine particles of the now ground material into the separator chamber 80 located directly above the grinding chamber 54. The classifier 44 then classifies the ground material whereby the oversize particles are made to automatically drop back down to the grinding zone 67 within the roller mill 40 whereupon they are subjected to further size reduction, i.e., further grinding. The fine particles of material, on the other hand, that are of the proper size are carried along in the airflow 98 and are subsequently discharged from the roller mill 10 through the duct 69.

Figure 1:
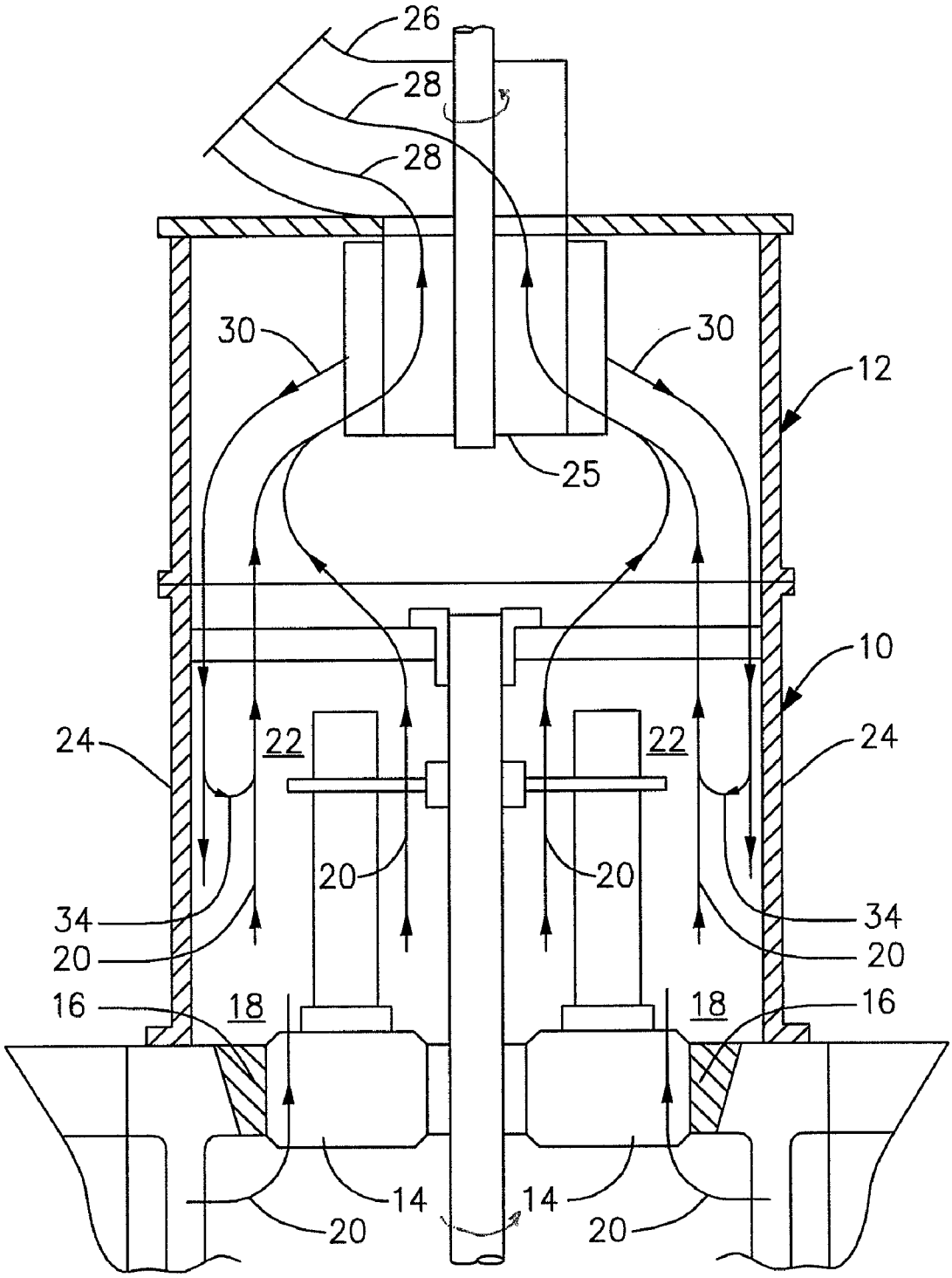
Figure 1 (Prior art)
FIG. 1 is a cross-sectional schematic view of a vertical roller mill illustrative of known prior art.

As noted hereinbefore in an exemplary embodiment of a roll mill 10 of the prior art as shown in FIG. 1, the grinding ring 16 has a substantially vertical grinding surface for engaging the substantially vertical outer grinding surface of the roll 14. Consequently, the material to be ground tends to easily and quickly fall from between the ring and roll. Furthermore, the vertical surface of the ring and rolls provide a clear path for the upper airflow, thus easily clearing the fine particles from between the grinding ring and the rolls. As described hereinbefore, the lack or reduction of material between the ring and roll increases the vibration, noise, and sliding of the ring and rolls. To overcome these problems the present invention provides a means for retaining material on the ring for a longer period of time, as well as means for reducing the slippage between the rolls and the ring.

Figure 3:
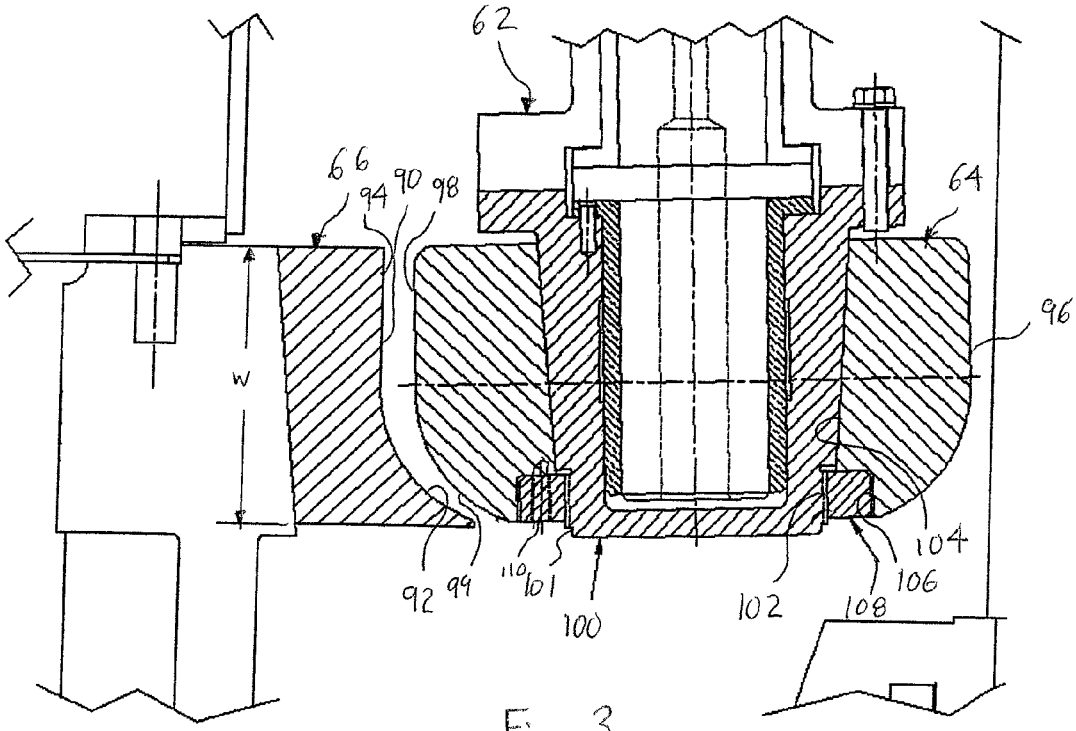
FIG. 3 is a cross-sectional view of a lower portion of the roller mill of FIG. 2 illustrating a lower portion of the grinding mechanism illustrating a roll and grinding ring arrangement in accordance with the present invention.

One exemplary embodiment of mill of FIG. 2 in accordance with the present invention for maintaining the material on the grinding ring 66 is illustrated in enlarged cross-sectional view of the grinding ring 66 and a roll in FIG. 3. As shown, the grinding ring 66 has an inner grinding surface 90 that includes a lower sloped portion 92. Specifically, the inner surface 90 of the grinding ring 66 includes a substantially vertical upper portion 94 and an inwardly sloped lower portion 92. The lower portion of the surface is generally concave and arcuate having a radius of up to one half of the height of the roll. The lower portion 92 extends inwardly approximately between one eighth and one half of the height of the roll from the vertical upper surface 94. The rolls 64 have an outer grinding surface 96 complementary to the inner grinding surface 90 of the ring 66. As shown in FIG. 3, the upper portion 98 of the roll 64 is substantially vertical, while the lower portion 99 is curved to match the contour of the lower portion 92 of the ring 66, such that the rolls grind the material disposed on at least a portion of the lower and/or upper portion of the ring.

During the operation of the mill 40, the vertical upper potion 94 of the ring 66 provides a surface that allows returning fine particles to fall down along the vertical surface of the ring without too much entrainment by the upward airflow 20 (see FIG. 1). The lower curved portion 92 of the ring slows down the material from falling off the grinding ring too quickly, and shields a portion of the inner surface 90 of the ring from the upward airflow, thus restricting or maintaining some material between the roll 64 and the ring 66 to serve as a cushion, which reduces the vibration and noise level caused by the rolls and ring. Additionally, the curved lower portion 92 increases the grinding surface area (by as much as 10%), which results in an increase mill throughput.

While the inner grinding surface 90 of the ring 66 is shown in FIG. 3 as having a lower 92 and upper portion 94 of approximately 50% of the width (w) of the ring, respectively, the present invention contemplates that the proportions between the lower and upper portions 92, 94 may vary. Further, the present invention contemplates that the entire inner surface 90 slopes inwardly, and thus having no vertical upper portion. Furthermore, while the lower portion 92 of the ring 66 is curved, the present invention contemplates that the lower portion may be flat having a frustoconical shape. It is further understood that for any contemplated embodiment of the grinding ring 66, the rolls 64 have a substantially complementary outer grinding surface 96 for intimately engaging the ring.

FIG. 4 illustrates another embodiment of the grinding ring 66' and the grinding roll 64' that embodies the present invention. Similar to the grinding ring 66 of FIG. 3, the grinding ring 66' of FIG. 4 has a concave grinding surface 90'. The upper portion 94' and the lower portion 92' of the ring 66' are curved. The curved upper portion 94' functions to further slow the falling of the particles down through the grinding ring and rolls to thereby maintain more particles between the ring and rolls. As discussed hereinbefore for the embodiment of FIGS. 2 and 3, the roll 64' of FIG. 4 has a grinding surface 96' that is complementary in shape to the grinding ring 66'. Furthermore, while the upper portion 94' of the ring 66' is curved, the present invention contemplates that the upper portion 94' may be flat having a frustoconical shape.

Referring to FIG. 3, the roll 64 is uniquely attached to the journal assembly 62 to provide a quicker and easier method of attaching or replacing a roll. Furthermore, this method embodying the present invention enables a greater portion 99 of the lower portion 99 of the roll 64 to be used to contact the grinding ring 66 to increase grinding production. The conventional method of attachment requires many bore holes in the roll area for receiving a plurality of bolts that attach to the journal assembly.

As shown, the journal assembly 62 includes an end cap 100 having a generally frustoconical shape. An end portion 101 of the end cap 100 is recessed and threaded at 102. The roll 64 includes a central through hole 104 having a tapered inner surface complementary to the outer surface of the end cap 100 of the journal assembly 62. The bottom of the roll has an annular recess 106 for accommodating a threaded fastener 108 (e.g., a nut). The fastener 108 and roll 64 includes at least one hole for securing the fastener to the roll with a screw or bolt 110 to prevent the fastener from loosening from the end cap of the journal. The thread of the end cap and fastener may also be counter-threaded to the direction of the rotation of the roll during operation to further prevent loosening.

It has been found that when the roller mill 10 of FIG. 1 is used for grinding fine particle sizes, a significant portion of the oversized particles rejected by the classifier at the top of the mill can still be quite fine. These rejected oversized particles returning back to the grinding zone 18 along the mill housing 24 in the downward particle flow 30 are subject to the airflow 20 flowing upward from the grinding chamber 22 to the classifier 12. This upward airflow 20 can entrain the rejected oversized particles quite easily and recirculate them back to the classifier, as shown at 34, where the classifier will reject the recirculated oversized particles again. This situation creates an internal recirculation of the oversized particles between the grinding chamber 22 and the classifier 12. As a result, a significant amount of rejected particles may never make it back to the grinding area to get further reground. These rejected oversized particles are thus suspended in the air stream, causing a pressure drop, which reduces mill capacity, and thus lowers the mill's efficiency. To reduce or eliminate this recirculation, the present invention shown in FIG. 5, includes a baffle 200 disposed within the mill side housing 48 of the roller mill 40.

Figure 5:
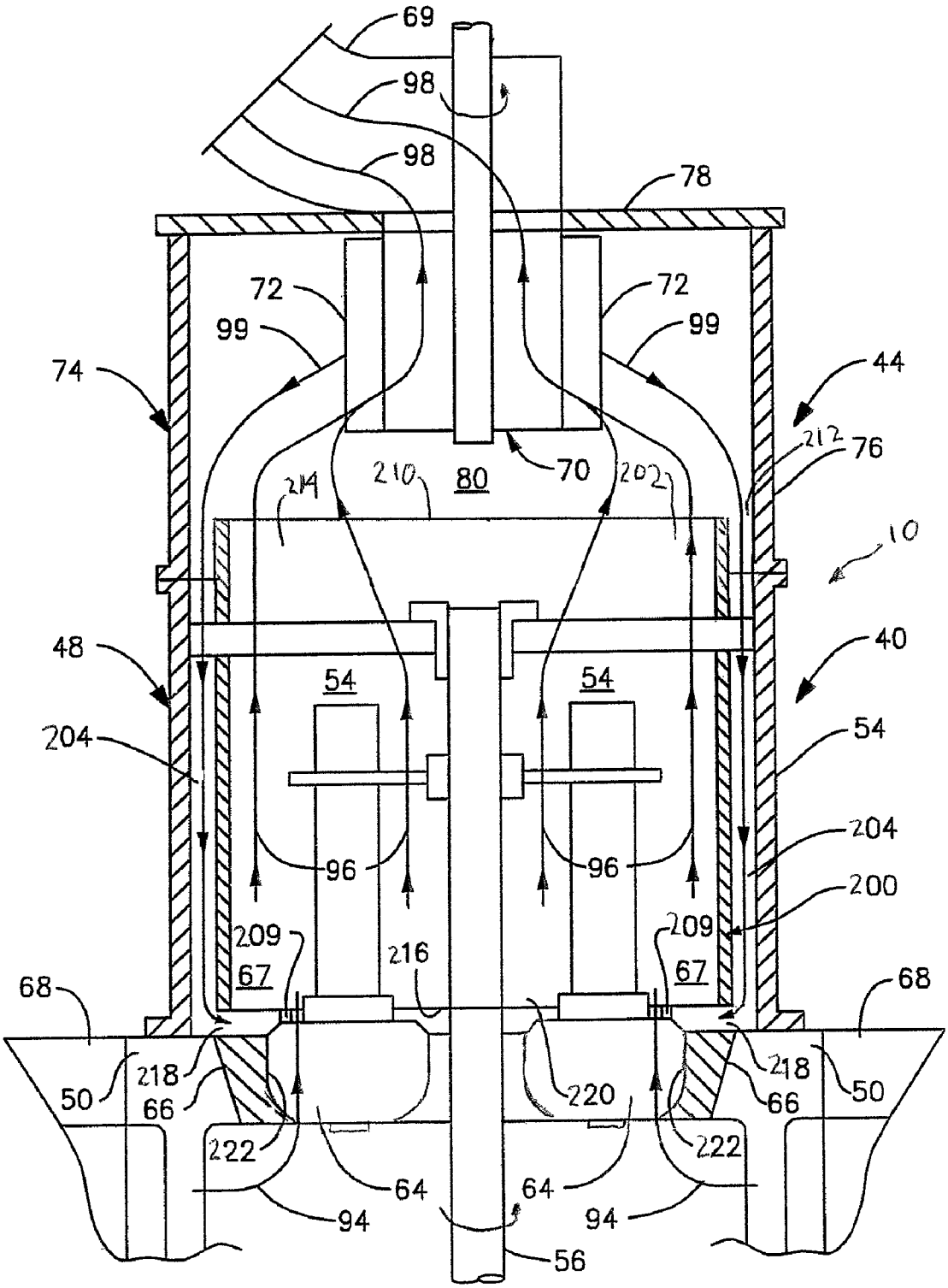
FIG. 5 is a cross-sectional schematic view of a roller mill embodying the present invention illustrating the airflow through the roller mill.

As best shown in FIG. 5, the baffle 200 is generally tube-shaped formed of a sheet metal material, which is secured in fixed relationship to the side wall 52 of the roller mill 40. The baffle 200 is disposed circumferentially around the grinding chamber 54 and spaced inward a distance from the mill side 48, to define two spaces within the roller mill 10, a central inner passage 202 and an outer annular return passage 204. As best shown in FIG. 5, the inner passage 202 provides means for directing airflow 26 upward from the grinding zone 67 to the separator chamber 80 of the classifier 44, while the baffle 200 and mill side wall 52 of the roller mill 40 define the outer annular return passage 204 for directing the downward particle flow 30 laden with oversized particles back to the grinding zone 67 of the roller mill 40.

The baffle 200 is secured in fixed spaced relation to the mill side 48 by a plurality of stand-offs 208 and/or legs 209 circumferentially spaced around the baffle. The baffle has an upper edge 210 that defines an input opening 212 of the return passage 204 and an output opening 214 of the inner passage 202. The baffle has a lower edge 216 that defines an output opening 218 of the return passage 204 and an input opening 220 of the inner passage 202.

Referring to FIG. 5, the baffle 86 extends circumferentially around the outer periphery of the grinding chamber 54. The baffle 200 is spaced a predetermined distance from the mill wall 52 to form the outer annular return passage 204 for the oversize particles rejected by the classifier 44. The width of the annular space 204 between the baffle 200 and the mill wall 52 is sufficient to receive the rejected oversized particles. In one embodiment the baffle 200 is disposed over a portion of the grinding ring 66. More, specifically, the diameter of the baffle 200 is approximately at the midpoint between the mill side wall 52 and the inner surface 222 of the grinding ring 66. Therefore, the diameter of the baffle is approximately:

$$D_{baffle}=0.5(D_h+D_r)$$

wherein $D_{baffle}$ is the diameter of the baffle; $D_h$ is the inner diameter of the mill housing; and $D_r$ is the inner diameter of the grinding ring.

Referring to FIG. 5, the lower edge 116 of the baffle 200 is spaced a distance from the upper portion of the mill base 50 and the grinding ring 66, such that there is sufficient clearance for the oversized particles to easily flow from the return passage 204 through the output opening 218 to the grinding zone 67. The height of the output opening 218 of the annular return passage 204 at the lower edge 216 of the baffle 200 is thus the spacing between grinding ring 66 and the lower edge of the baffle. The output opening of the return passage 104 should be approximately:

$$S_{baffle}=0.5(D_b-D_r)\tan(\theta)+1 \text{ inch}$$

wherein $S_{baffle}$ is the spacing between the lower edge of the baffle and the grinding ring; $D_b$ is the diameter of the baffle; $D_r$ is the inner diameter of the grinding ring; and θ is the angle of repose of oversized material or annular ramp.

Figure 6A:
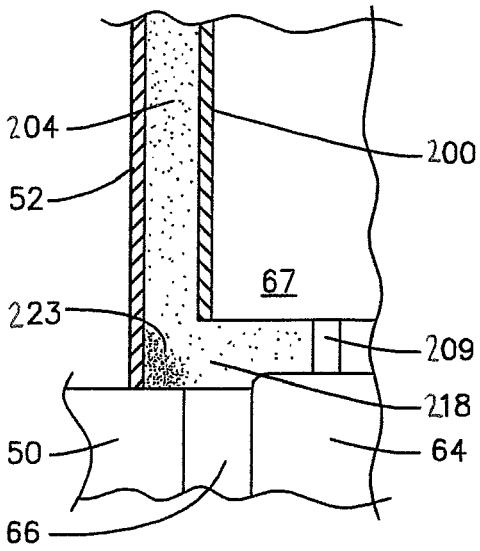
FIG. 6*a* is a cross-sectional view of a lower portion of the roller mill of FIG. 5 illustrating a lower portion of a baffle and mill side wall at the grind zone.

Typically, the material angle (θ) of repose is approximately 40 degrees. One skilled in the art can appreciate that as the oversized particles flow downward through the annular passage 204 and out the lower output opening 218 into the grinding zone 67, particles will collect around the outer edge and corner along the bottom outer edge of roller mill 40. As such, the material will collect in the form of a ramp 223 having a slope of approximately 40 degrees as illustrated in FIG. 6*a*. This collected material is factored in, as shown above, when determining the height of the output opening 218. While the output opening 218 must be of sufficient size to ensure free particle flow from the annular passage 204 to the grinding zone 67, the height of the output opening 218 should be small enough to prevent the upward airflows 94,96 from flowing into the return passage 204. For example, the height of the output opening 218 may not be more than one inch over $0.5(D_b-D_r)\tan(\theta)$. While the formula above provides for an additional one (1) inch spacing for the spacing ($S_{baffle}$), the present invention contemplates that the additional may be less or greater than one (1) inch providing the lower outlet 218 is sufficiently space to permit passage of the oversize particles while eliminating or minimizing upward air flows 94,96 (see FIG. 5) therethrough.

Figure 6B:
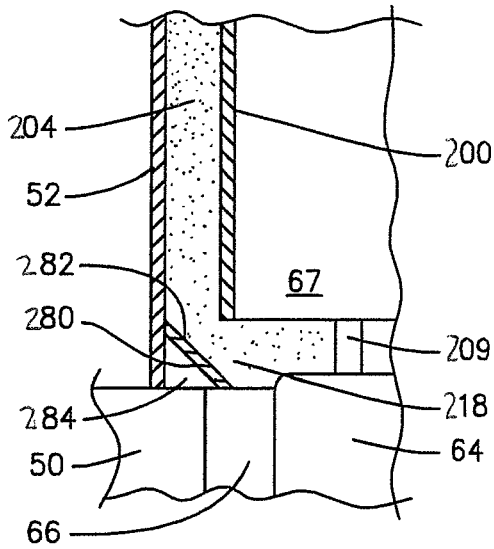
FIG. 6*b* is a cross-sectional view of a lower portion of the roller mill of FIG. 5 illustrating the lower portion of the baffle and mill side wall at the grind zone having a annular ramp in accordance with the present invention.

As shown in FIG. 6*b*, the present invention may include an annular ramp 280 disposed at an angle circumferentially around the outer lower edge or corner 284 of the roller mill 40 to prevent the build up of oversized particles at bottom of the annular passage 204 (as shown in FIG. 6*b*) and provide a sloped surface 282 for directing the oversized particles to the lower output opening 218 and into the grinding zone 67. The angle of the sloped surface 282 may be approximately in the range of 30-60 degrees. Generally, the angle of the sloped surface 282 should be sufficiently steep to promote the exit of the oversized particles from the annular passage 204, while allowing a sufficiently small lower output opening 118 to prevent or minimize upward air flows 94,96 (see FIG. 5) from the grinding chamber into the annular passage. While the annular ramp 280 is shown as formed a sheet of material, the present invention contemplates the annular ramp may be in the form of a wedge that fits into the lower outer corner 284 of the roller mill 40.

Regarding the height of the baffle 200, the baffle should extend as far upward as possible such that restriction of the upward airflow 96 through the output opening 214 of the inner passage 202 of the baffle 200 to the classifier 44 is minimized to provide efficient operation of the classifier. Typically, the baffle 200 can extend to a height about equal to height of the mill side housing 48. However, the invention contemplates that the elevation of the upper edge 210 of the baffle 200 may be disposed above or below the height of the mill side housing 48. For example, an optimal elevation of the baffle 200 for a roller mill 40 having a turbine-type classifier similar to that shown is:

$$S_{baffle}=(D_b-D_t)/3$$

wherein $S_{baffle}$ is the spacing between the upper edge of the baffle and the bottom of the centrifugal classifier; $D_b$ is the diameter of the baffle, and $D_t$ is the turbine classifier outer diameter.

Further, an optimal elevation of the baffle 200 for a roller mill 40 having a whizzer type classifier 200 is:

$$S_{baffle}=(D_w-D_d)/2$$

wherein $S_{baffle}$ is the spacing between the upper edge of the baffle and the bottom of the whizzer-type classifier; $D_w$ is the outer diameter of the whizzer classifier blades, and $D_d$ is the diameter of the lower deck disc of the whizzer.

Referring to FIG. 5, the mill side wall 52 of the roller miller 40 includes a feed opening 140 for feeding material into the grinding chamber 54. A rotary feeder 42 is attached to the side of the mill side wall 52 for feeding the material through the opening 140 in the mill side wall. The rotary feeder includes a hopper 142 for receiving material to be pulverized in the roller mill and a rotary means 144 for moving the material through the opening 140 to an input chute 146 into the grinding chamber 54. The baffle 200 similarly includes a feed opening 146 to permit the material to also pass through the baffle into the grinding zone 67. The input for chute 146 of the rotary feeder extends through both the mill side wall 52 and the baffle 200. An upper wall (not shown) of the input chute 146 may have a pair of outwardly sloping surfaces (not shown) to prevent the oversized particles flowing downwardly through the return passage 204 from collecting on the top surface of the input feed chute 146 extending therethrough.

In accordance with the mode of operation of the roller mill 40 of FIG. 5 the material, which is to be pulverized, i.e., ground, therewithin, is introduced at a controlled rate by means of the rotary feeder 42, and falls to the mill bottom in the grinding zone at 67. As a result of the coaction between the grinding rolls 64 and the grinding ring 66, the pulverization, i.e., grinding, of the material occurs. A large volume of air enters the roller mill 40 through tangential ports with which the air vents 68 provide for this purpose immediately below the grinding ring 66. This large volume of air 94,96 is operative to sweep the fine and medium fine particles of the now ground material into the separator chamber 80 located directly above the grinding chamber 54. The classifier 44 then classifies the ground material whereby the oversize particles are made to automatically drop back down to the grinding zone 67 within the roller mill 40 whereupon they are subjected to further size reduction, i.e., further grinding. The fine particles of material, on the other hand, that are of the proper size are carried along in the airflow 98 and are subsequently discharged from the roller mill 10 through the duct 69.

Referring to FIGS. 2 and 4, the present invention reduces the recirculation of the rejected oversize particles by creating a separate particle return passage 104, whereby the oversized particles are not subject to the upward airflow 96. This new invention with the mill side baffle is suitable for improving the mill efficiency for all size product requirements, as well as improve the fineness of the ground material. Further the baffle provides more particles to the grinding ring 66 and rolls 64 to maintain more material therebetween, especially for fine grinding applications. Further, the baffle 200 improves the classifier rejected fine particle return path 99 to ensure the rejected fine particles return back to the grinding zone for regrinding without being re-entrained back at 34 (see FIG. 1) into the upward air stream 96. The roll and ring design of FIGS. 2 and 4 further improves the grinding aspect of the fine particles. The roll and ring design creates a layer of material between the roll 64 and ring 66 for more efficient grinding and less vibration, provides more surface area for grinding, and provides more residence time for particles to stay in between the roll and ring due to the curved lower portion 92 of the ring to enable finer grinding. Consequently, the baffle 200 and the roll 64 and ring 66 design provide an improved means for directing the fine particles to the roll and ring, whereby the roll and ring provides improved grinding to produce finer particles.

Figure 7:
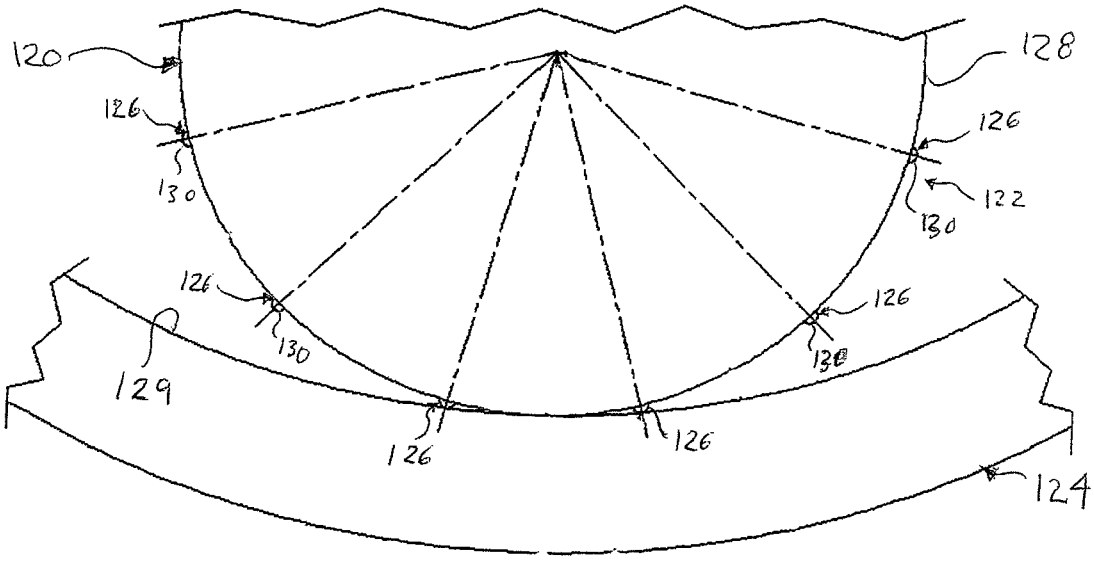
FIG. 7 is a sectional view of a grinding ring and a roll having a plurality of circumferentially-spaced ribs in accordance with the present invention.

FIG. 7 illustrates an exemplary embodiment of the present invention whereby the rolls 120 include a tread 122 to help eliminate or reduce slippage or sliding between the rolls 120 and the ring 124 when grinding fine particles. As shown, the tread 122 may be in the form of vertical ribs 126 circumferentially-spaced on the outer grinding surface 128 of the roll 120. The ribs 126 extend continuously the width of the roll. The ribs have a rounded engagement surface 130. The ribs 126 should extend approximately one eighth to one quarter inches from the grinding surface 128 of the roll 120. One will appreciate that the rib 126 should protrude sufficiently, but low enough to minimize grinding noise and provide sufficient surface to surface 128, 129 contact of the roll and grinding ring. The ribs 126 are circumferentially-spaced a predetermined spacing such that only one rib substantially engages the inner surface of the ring 124. In other words, the ribs should be spaced so that the grinding surfaces 128, 129 of the roll and ring 120, 124 are in contact during the grinding process, while a rib is in contact with the ring. As shown in FIG. 7, the ribs are circumferentially-spaced such that as one rib 126 disengages from the ring the subsequent rib engages the ring 124. One will appreciate that if the ribs are too close, the grinding surfaces 128, 129 of the ring and roll would not make contact. The circumstantial spacing of the ribs 126 is therefore dependent upon the dimensions of the ribs and the radius of the ring and the roll. The surface 128, 129 of both roll and ring may have a certain roughness so as to avoid slip condition especially for the roll engagement with the ring. This ribbed tread design reduces the roll skidding condition while grinding fine particles and reduce the pounding and vibration level.

While the tread 122 (e.g., ribs 126) are illustrated as being disposed on the rolls 120, the present invention contemplates that the tread may alternatively be disposed on the inner grinding surface 129 of the ring 124. While the ribs 126 are described and shown as being continuous, and extend the width of the roll 120, the invention contemplates that each of the ribs may extend a portion less than the entire width of the roll and the rib may be disposed at any portion of the roll (e.g., lower, intermediate, or upper portion). Furthermore, each rib 126 may be in the form of a plurality of vertically disposed ribs or sections of ribs, including a plurality of vertically-disposed nubs. Further, while the ribs 126 described herein are generally uniform, the present invention contemplates that the ribs may be different having different configurations. While the ribs are shown having rounded engagement edges, the outer edges may have any shape or form, such as sharp edges, polygonal edges, or concave edges. The present invention further contemplates that the ribs may be spaced further apart than shown in FIG. 4 to increase the contact of the grinding surfaces of the ring and roll, however, the roll may experience some slippage. One will also appreciate that the treads may be disposed on the ring and rolls of the assemblies shown and described herein including FIG. 1. The invention further contemplates that the surfaces of the rolls 64 and/or the inner surface of the ring 66 have a roughed overlay welding surface, or a textured surface can achieve the similar effect as the ribbed roll and ring design, as described hereinbefore, to have a similar effect.

One will appreciate that present invention is applicable to any type of pendulum type of mills having a vertical grinding ring and grinding rolls, which includes Raymond® Roller Mill and mills from other manufacturers with similar designs.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A grinding mechanism for a roller mill for pulverizing material; said grinding mechanism comprising:

a grinding ring oriented in a generally horizontal position, having a central opening and an inner grinding surface wherein the inner grinding surface includes an inwardly sloped lower portion and a substantially vertical upper portion; and a grinding roll that coacts with the grinding ring to pulverize the material, the grinding roll having an outer grinding surface with a substantially vertical upper portion and a lower portion of the outer grinding surface that is complementary to the inner grinding surface of the grinding ring.

2. The grinding mechanism of claim 1, wherein the lower portion of the inner grinding surface of the grinding ring is curved.

3. The grinding mechanism of claim 1, wherein the lower portion of the inner grinding surface of the grinding ring is concave.

4. The grinding mechanism of claim 1, wherein the lower portion of the inner grinding surface of the grinding ring is generally frustoconical.

5. The grinding mechanism of claim 1, wherein the lower portion and an upper portion of the inner grinding surface of the grinding ring are sloped toward the central opening of the grinding ring as it extends downwardly.

6. The grinding mechanism of claim 1, wherein the lower portion of the grinding ring extends inwardly to shield a portion of the material disposed on the inner grinding surface of the grinding ring.

7. The grinding mechanism of claim 1, wherein the lower portion of the grinding ring extends inwardly approximately one eighth to one half of the height of the roll.

8. The grinding mechanism of claim 1, wherein a substantial portion of the inner grinding surface of the grinding ring slopes toward the central opening of the grinding ring as it extends downwardly.

9. The grinding mechanism of claim 1, further including a journal having a threaded end portion, wherein the threaded end of the journal extends through a central hole in the grinding roll whereby a threaded fastener engages the threaded end of the journal for securing the grinding roll to the journal.

10. The grinding mechanism of claim 1, wherein the grinding roll includes a tread extending from the outer grinding surface of the grinding roll.

11. The grinding mechanism of claim 1, wherein the grinding ring includes a tread extending from the inner grinding surface of the grinding ring.

12. A grinding mechanism for a roller mill for pulverizing material; said grinding mechanism comprising:

a grinding ring oriented in a generally horizontal position, having a central opening and an inner grinding surface; and a grinding roll that coacts with the grinding ring to pulverize the material, the grinding roll having a generally cylindrical shape with an outer grinding surface having a vertical upper wherein at least one of the inner surface of the grinding ring and the outer surface of the grinding roll includes a tread.

13. The grinding mechanism of claim 12, wherein the tread includes a plurality of protrusions circumferentially-spaced around at least one of the inner surface of the grinding ring and the outer surface of the grinding roll.

14. The grinding mechanism of claim 13, wherein the protrusions are spaced such that only one protrusion substantially engages the inner grinding surface of the grinding ring.

15. The grinding mechanism of claim 12, wherein the tread includes a plurality of ribs circumferentially-spaced around at least one of the inner surface of the grinding ring and the outer surface of the grinding roll.

* * * * *